United States Patent [19]

Off

[11] Patent Number: 4,989,527

[45] Date of Patent: Feb. 5, 1991

[54] SEWING SYSTEM

[75] Inventor: Joseph W. A. Off, Irving, Tex.

[73] Assignee: Automated Machinery Systems, Inc., Richmond, Va.

[21] Appl. No.: 78,007

[22] Filed: Jul. 24, 1987

Related U.S. Application Data

[63] Continuation-in-part of Ser. No. 909,314, Sep. 19, 1986, abandoned.

[51] Int. Cl.[5] ..... D05B 3/04

[52] U.S. Cl. ..... 112/121.15; 112/104; 112/121.27; 112/163; 112/311

[58] Field of Search ..... 112/102, 103, 104, 121.12, 112/121.15, 121.27, 163, 221, 308, 309, 311, 320

[56] References Cited

U.S. PATENT DOCUMENTS

| | | | |
|---|---|---|---|
| 1,142,082 | 6/1915 | Diehl et al. | 112/221 |
| 1,998,885 | 4/1935 | Rosenthal | 112/104 |
| 2,329,681 | 9/1943 | Zeier | 112/221 X |
| 3,312,184 | 4/1967 | Cash | 112/163 X |
| 3,680,508 | 8/1972 | Baig et al. | 112/121.12 |
| 4,043,283 | 8/1977 | Jung | 112/163 |
| 4,386,573 | 6/1983 | Davidson et al. | 112/103 |
| 4,389,957 | 6/1983 | Block et al. | 112/121.27 X |
| 4,395,960 | 8/1983 | Jung | 112/163 X |
| 4,434,729 | 3/1984 | Davidson | 112/121.12 |
| 4,459,925 | 7/1984 | Miyachi et al. | 112/121.27 X |

FOREIGN PATENT DOCUMENTS

| | | | |
|---|---|---|---|
| 3048782 | 7/1982 | Fed. Rep. of Germany | 112/308 |
| 980035 | 1/1965 | United Kingdom | 112/102 |

*Primary Examiner*—Werner H. Schroeder
*Assistant Examiner*—David K. Suto
*Attorney, Agent, or Firm*—Bacon & Thomas

[57] ABSTRACT

A sewing system that is smaller and more simple in construction than the prior art. The cloth holding means and cloth clamping means are part of a X-Y-Z motion apparatus that is supported solely from the top arm of the sewing system frame.

Because the spaced twin needles of the sewing system will be required to penetrate up to 14 layers of thick cloth in some anticipated applications, considerable rigidity and stability is imparted to the single needed clamp that supports the two needles by reciprocating the needle clamp with two symmetrically spaced needle bars. This minimizes canting of the needle clamp and bending of the needle bar, thereby assuring more uniform stitch lines and minimizes missed stitches.

3 Claims, 7 Drawing Sheets

SEWING SYSTEM

RELATED APPLICATION

This application is a continuation-in-part of application Ser. No. 909,314, filed Sept. 19, 1986, now abandoned for Improved Sewing System, by Joseph W. A. Off.

BACKGROUND OF THE INVENTION

This invention relates to an improved sewing system that is more economic and simpler to construct, has improved operating characteristics, and is more versatile in its uses than prior sewing machines of this type. The sewing machine of this invention will be described in connection with twin needle sewing apparatus. The apparatus is illustrated and described in connection with the operation of stitching belt loops to the waistband of blue jean type trousers, although its use is not restricted to that type of operation.

The sewing system of this invention is smaller than the usual industrial type sewing machine, and has a cloth holder that is suspended from the upper horizontal arm rather than being supported on the base. The cloth holder in a presently preferred embodiment is automatically controllable in the X-Y-Z directions. In keeping with its smaller structure, the up-down motion of the cloth or workpiece clamp that is associated with the cloth holder is solely vertical rather than being along an arc of a pivot arm as is common in the prior art.

In prior art sewing machines that employ twin needles spaced apart on a horizontally extending needle clamp, it has been found that the single needle bar and needle clamp will bend and deflect as a result of the needles being deflected as they penetrate anywhere from 6 up to 14, for example, layers of heavy cloth of the belt loop and waistband. In this invention I overcome that problem by employing two symmetrically spaced needle bars to support and actuate the needle clamp member.

Rather than having the main frame or housing of the machine made of one or more castings or extrusions as in the prior art, the vertical and base arms of the sewing machine of this invention are made up respectively, of short members of tubular steel stock and a short U-shaped channel member. The top arm is a short milled block. The individual short members or arms are joined together to make the frame. The use of the individual short members avoids having to machine a large, bulky, and irregularly shaped castings as was required in constructing the conventional industrial sewing machines of the prior art. All necessary machining is done on the individual short members before they are joined together to form the rigid, integral frame.

BRIEF DESCRIPTION OF THE DRAWINGS

The invention will be described by referring to the accompanying drawings wherein.

DETAILED DESCRIPTION OF PREFERRED EMBODIMENTS

Figure 1:
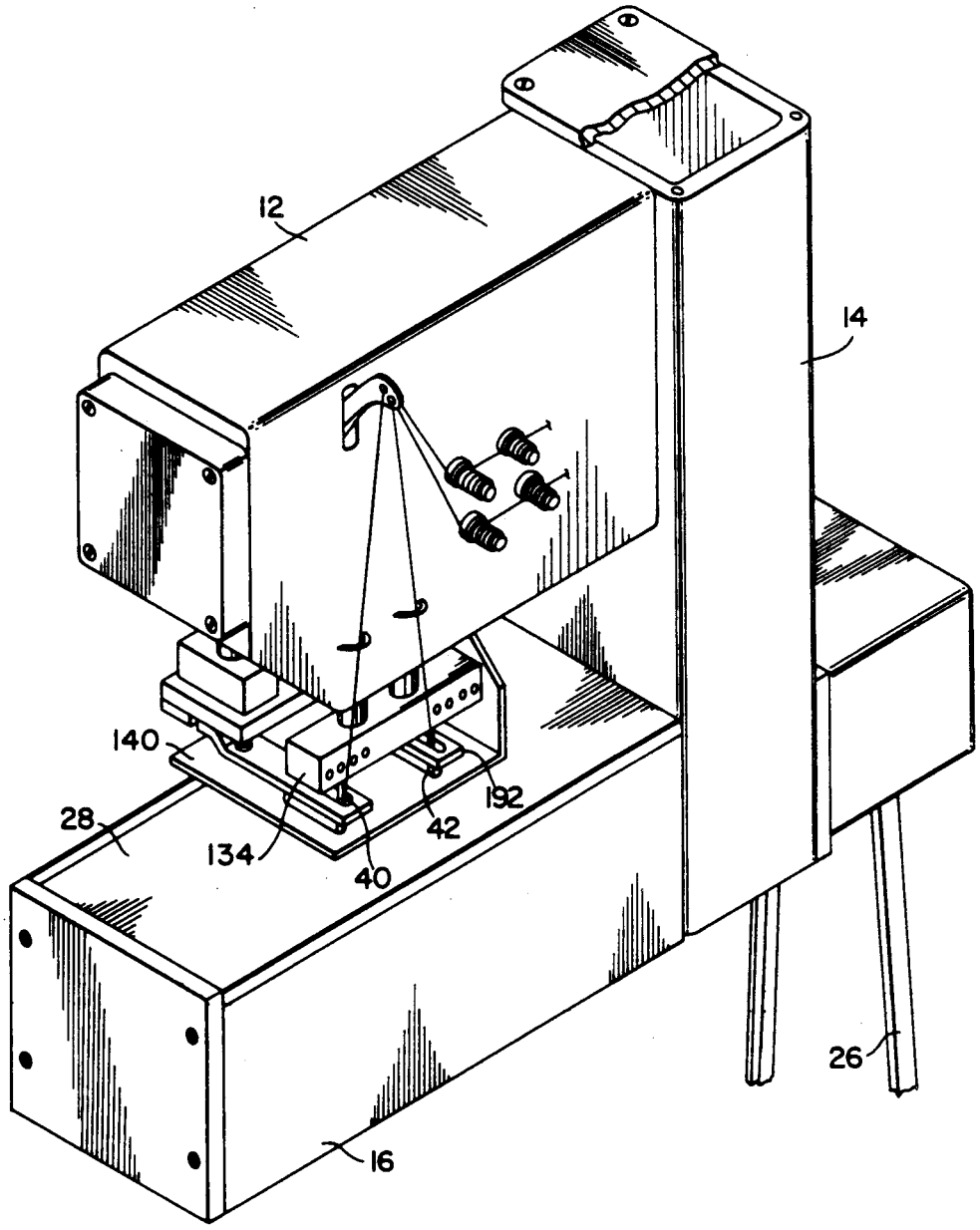
FIG. 1 and 2 are, respectively, simplified perspective and side views of the sewing machine of my invention.
Figure 2:
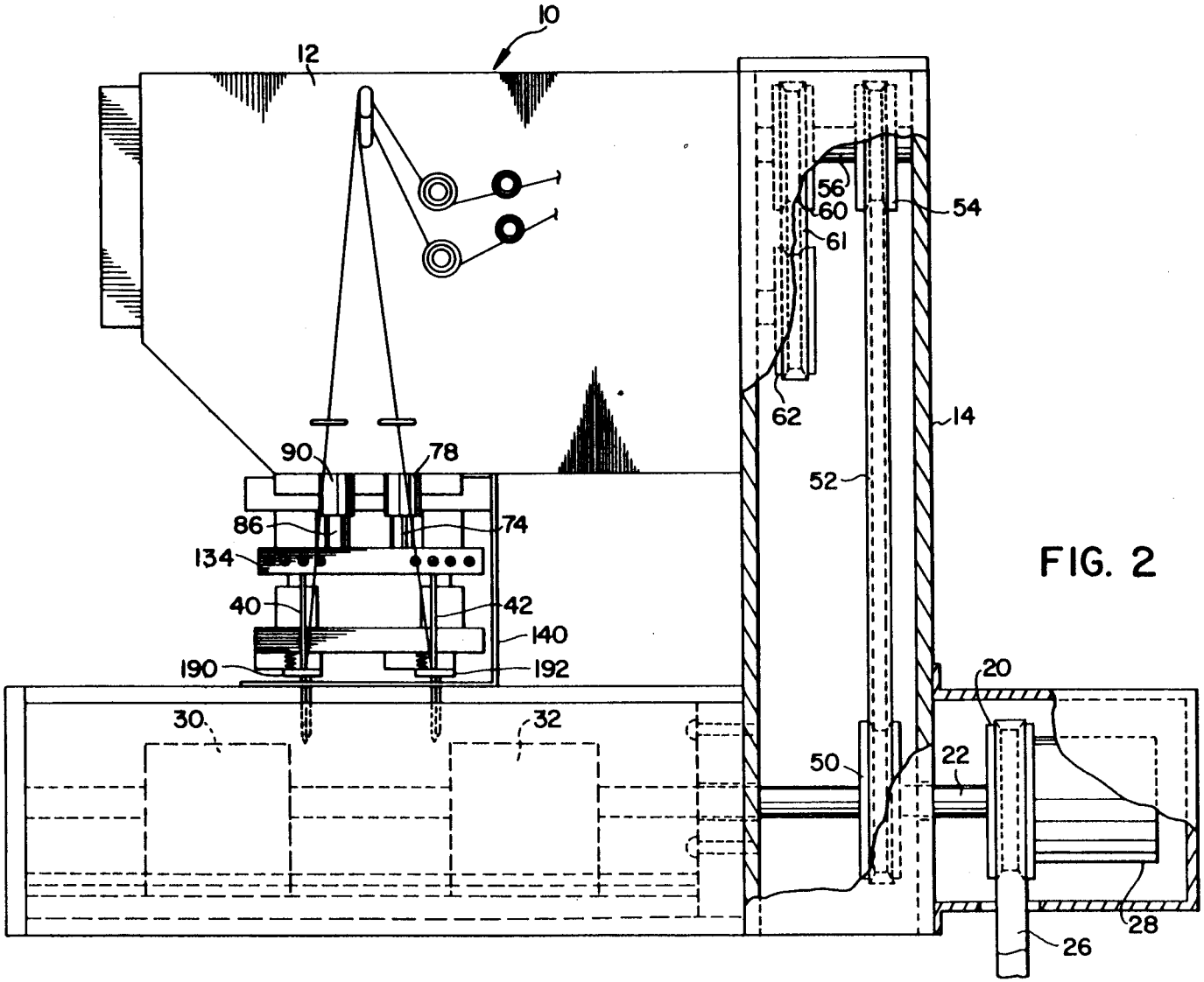

Referring to FIGS. 1 and 2, the sewing machine of this invention is comprised of a top arm 12, a vertical arm 14, and a base arm 16. The vertical arm is made from rectangular, welded seam, tubular steel stock that is a standard item of commerce and readily available. Base arm 16 is a U-shaped channel member that may be stamped or bent, or it may be milled from rectangular tubular stock. Top arm 12 is machined from a solid metal block. As illustrated in FIGS. 1 and 2, top arm 12 and base arm 16 are short when compared with most industrial sewing machines. Because the apparatus of this invention is useful for the stitching of belt loops onto the waistband of trousers and other small areas, the lengths of arms 12 and 16 need only be long enough to accommodate a waistband of the trousers and to house the necessary stitch forming mechanisms therein. This permits the sewing system to be small and relatively portable and permits easy set-up and take-down.

As seen in FIG. 2, a drive pulley 20 is disposed adjacent the bottom end of vertical arm 14 and is secured to main drive shaft 22 that extends horizontally through the interior of the channel shaped bottom arm 16. Pulley 20 is driven by belt 26 that in turn is driven by an electric motor (not illustrated) which may be under control of a programmed microprocessor-based control system. Because the control system is not part of my invention, and because such control systems now have become common in the art, such a control system will not be described herein, other than to point out that synchronizer and timing means 28 provides signals to the control system to indicate the up-down positions of the needles.

Figure 6:
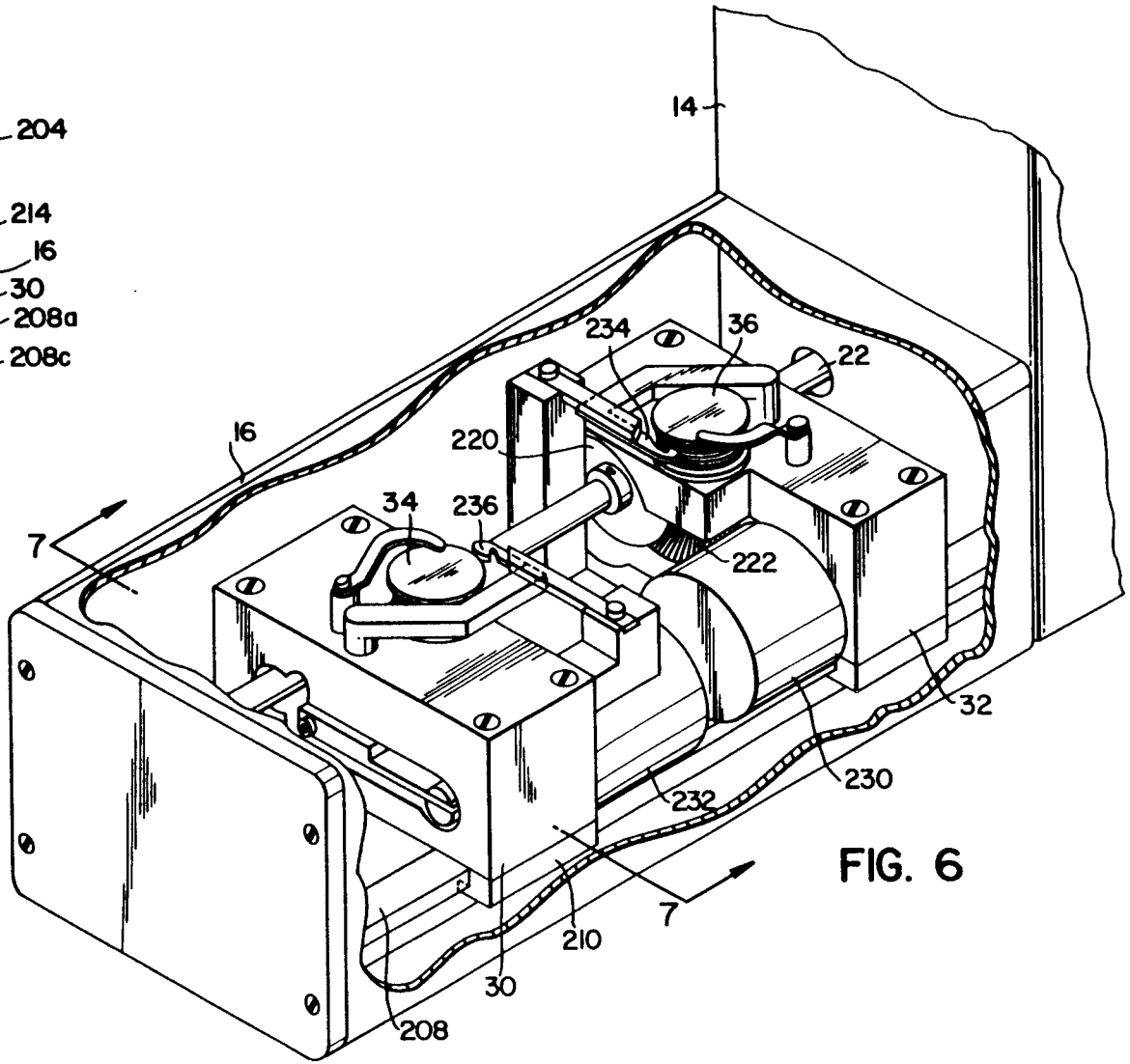
FIG. 6 and 7 are simplified perspective and vertical sectional illustrations of the lower or base arm of the sewing system of this invention.

As illustrated in simplified form in FIGS. 2 and 6 bottom arm 16 includes two looper blocks 30, 32 that contain the respective bobbins 34 and 36 and associated mechanisms that cooperate with the two needles 40, 42 to form the lock stitches in the conventional manner. As is common with industrial sewing machines, the looper blocks include knife blades 234, 236 that are operated at appropriate times by the control system to cut the threads from the respective needle and bobbin.

Figure 3:
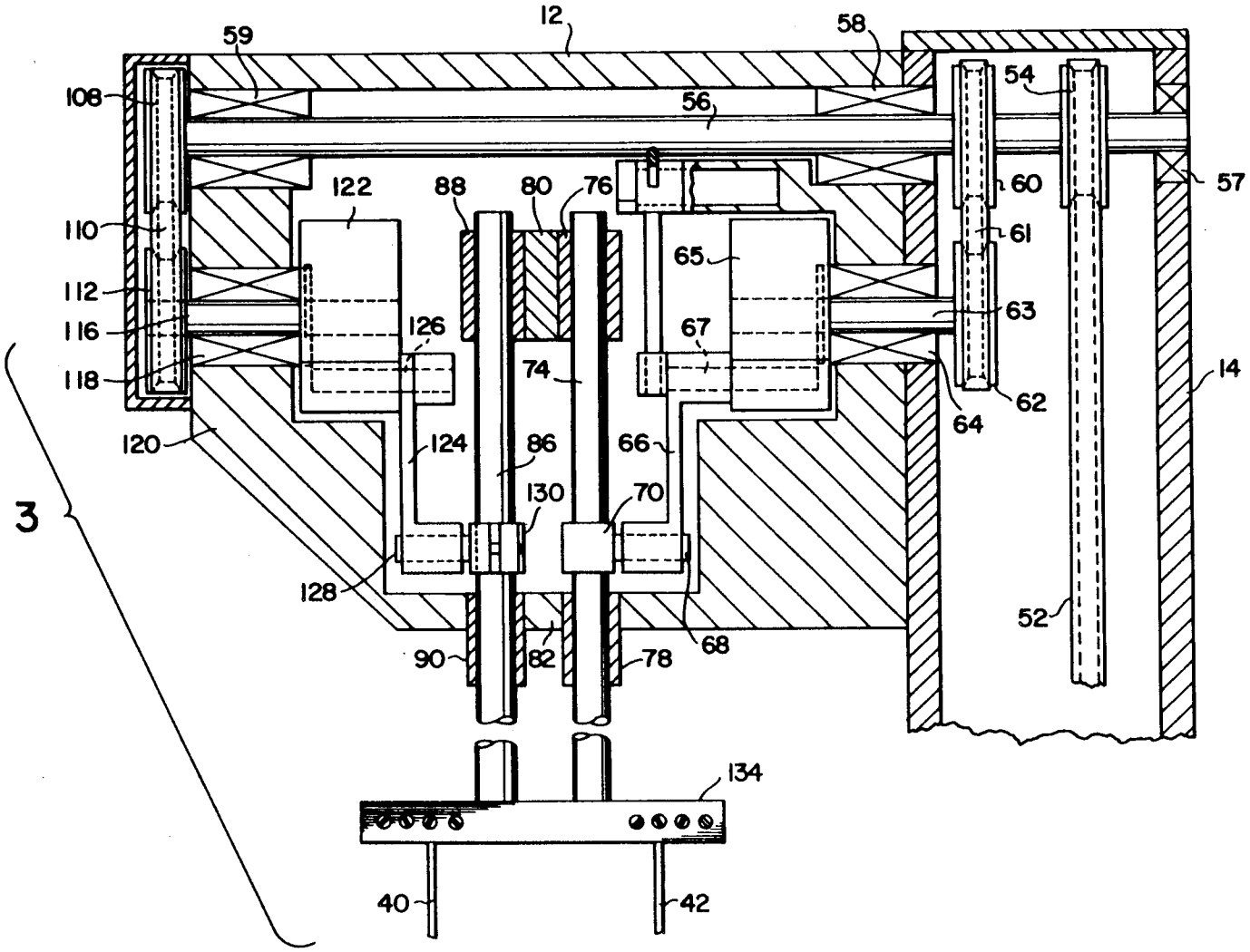
FIG. 3 is a simplified illustration that shows one embodiment of the activating means in the top horizontal arm for reciprocating twin needle bars.

As illustrated in FIG. 2 and 3, a pulley 50 that is secured to main drive shaft 22 drives a belt 52 that extends through the interior of arm 14 and passes over an upper pulley 54 to rotate shaft 56 when drive pulley 20 is rotated by the drive motor and belt 26. Upper shaft 56 is supported by bushing 57 and 58 on its right side and by bushing 59 on its left end. A second pulley wheel 60 is secured to upper shaft 56 within vertical arm 14 and drives a belt 61 that extends around pulley 62. Pulley 62 is secured to the right end of a short shaft 63 that rotates in bushing 64. An eccentric crank wheel 65 is secured to the left end of shaft 63. A crank arm 66 is pivotally coupled at its top end, as viewed in FIG. 3, to a pin 67 that is positioned off-center on the left face of eccentric crank wheel 62.

The bottom end of crank arm 66 pivotally engages a pin 68 that is retained by a clamp member 70 that is clamped about a first one of two needle bars 74. Needle bar 74 is slidingly retained within upper and lower linear bearings 76 and 78 that are retained in respective bushing blocks 80, 82 in the milled upper arm 12. It may be seen that as belt 52 rotates pulley 54 and upper shaft 56, eccentric crank wheel 65 causes crank arm 66 to raise and lower, thereby reciprocating needle bar 74 up and down within its bushings 76 and 78. As seen in FIG. 3, bushing 78 passes through the bottom wall of top arm 12.

The second needle bar 86 is similarly reciprocated up and down in its bushings 88, 90 in synchronism with the first needle bar 74 by the mechanism now to be described. A pulley 108 is secured to the left end of shaft 56 and drives a belt 110 that passes about a lower pulley 112. Lower pulley 112 is secured to a lower shaft 116 that rotates in bearings held in bearing block 120.

A second eccentric crank wheel 122 is secured to the right end of lower shaft 116, and the top end of crank arm 124 is pivotally connected thereto by pin 126 that is positioned off-center on the right face of eccentric crank wheel 122. The bottom of the second crank arm 124 pivotally engages pin 128 that is held by clamp 130 which is attached to the second needle bar 86.

From the above description it may be seen that rotary motion of upper drive shaft 56 is transferred to the second eccentric drive wheel 122 by means of pulley 108, belt 110 and pulley 112 to lower shaft 116. The rotation of eccentric drive wheel 122 raises and lowers crank arm 124 to reciprocate second needle bar 86 within its linear bearings 88 and 90.

Needle bar clamps 70 and 130 are secured to their respective needle bars 74 and 86 at substantially the same locations thereon so that the bottoms of the two needle bars are at the same vertical heights. The bottoms of the two needle bars are symmetrically secured, as by means of threaded connections, to spaced positions on horizontally disposed needle clamp 134. The pair of needles 40, 42 are symmetrically positioned in two of a plurality of clamps in needle clamp 134. The positions in needle clamp 134 where needles 40 and 42 are secured may be changed to accommodate belt loops of various lengths.

The double support for needle clamp 134 that is provided by the jointly reciprocating needle bars 74 and 86 adds significant rigidity and stability to needle clamp 134 and better assures that needles 40 and 42 will penetrate the multiple layers of a workpiece with a minimum of deviation in their paths through the workpiece. When belt loops are positioned on the waistband of a pair of blue jeans, there may be as many as up to 14 layers, for example, of the relatively thick denim material that the twin needles must penetrate. With a single needle bar centrally supporting the needle clamp, the unequal resistances encountered by the two needles tends to cause the needle clamp and needle bar to tilt and become skewed from their desired positions. Not only is this undesired skewing and bending likely to cause an uneven stitch pattern, but more importantly, it is possible for the needle to miss the thread loop formed by the bobbin and loop mechanism, thus resulting in missed stitches. This, of course, is most unacceptable in a commercial sewing system whose purpose is to sew through multiple layers of thick cloth. The double support at symmetrically spaced locations on the needle clamp adds substantially to the rigidity and stability of the needle clamp and needles and better assures more uniform stitches and fewer missed stitches.

Figure 4:
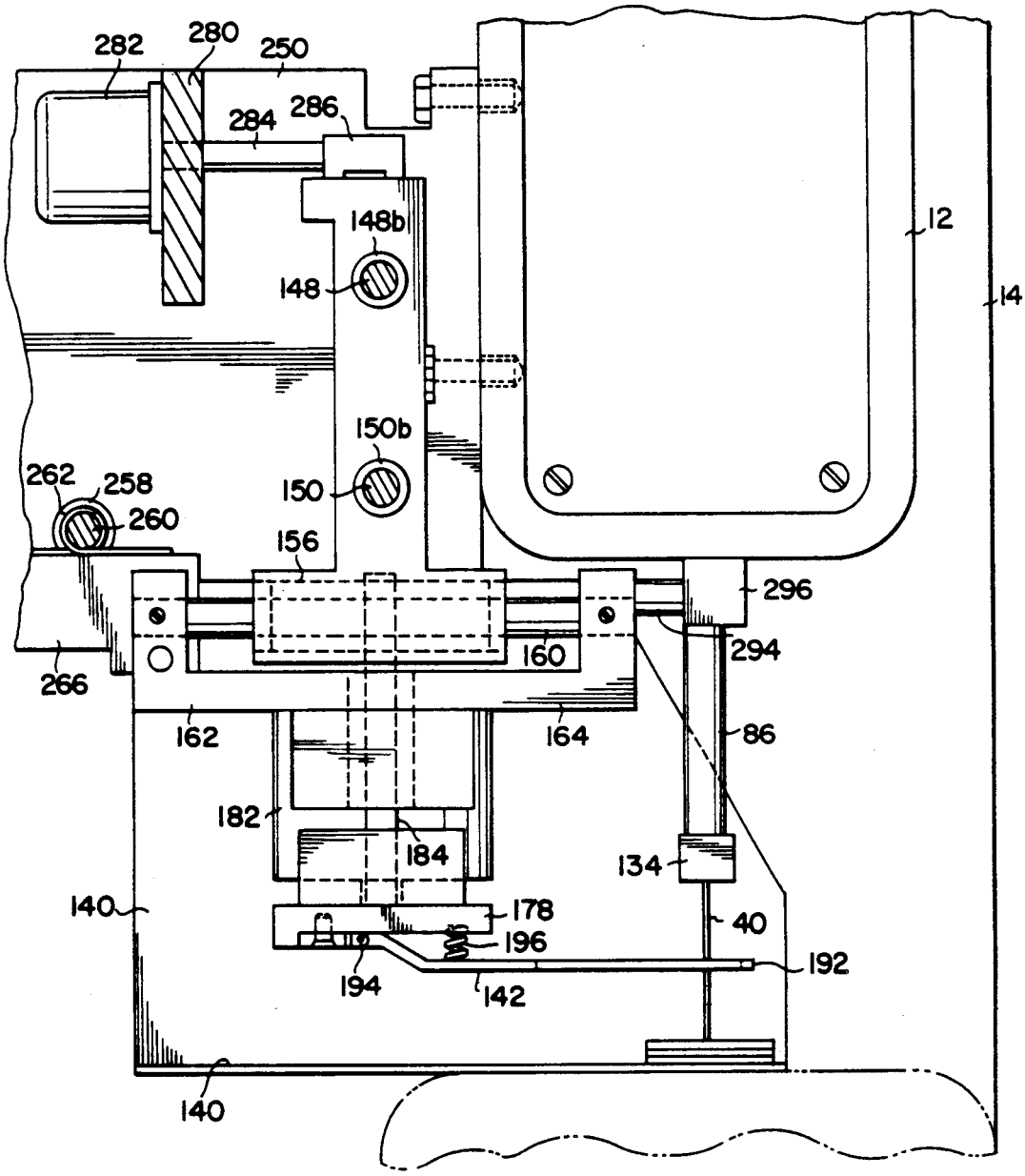
FIG. 4 is a simplified illustration of the cloth holder and clamp and their X-Y-Z motion apparatus that is secured to the top horizontal arm.
Figure 5:
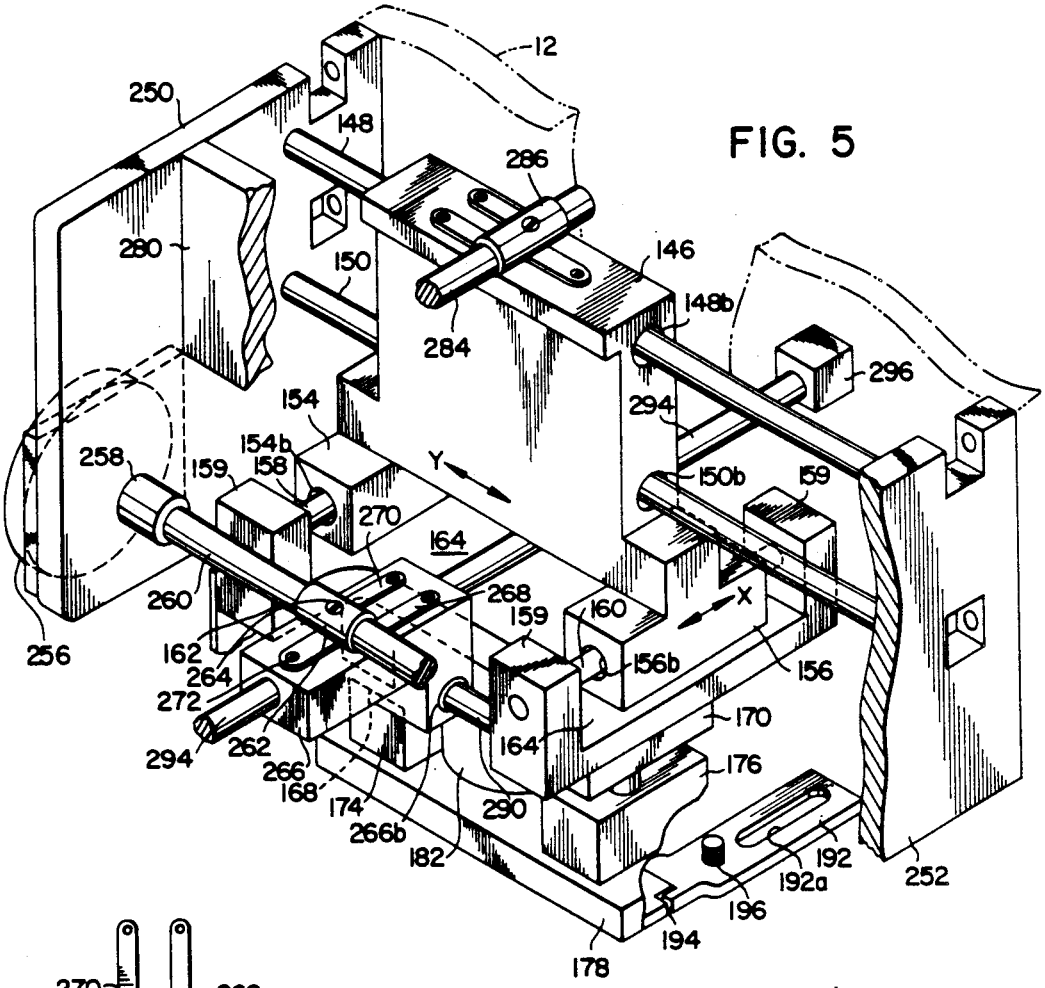
FIG. 5, 5*a* and 5*b* are further illustrations of the X-Y-Z motion apparatus and the cloth holder and clamp.

An important feature of this invention that significantly simplifies its construction and contributes to its small size is the construction and arrangement of the mechanism that provides the X-Y-Z motion of the cloth holder and clamp relative to the reciprocating twin needles 40, 42. As illustrated in FIGS. 4 and 5, the X-Y-Z mechanism is secured to the back side of the horizontal upper arm and extends downwardly to selectively position the L-shaped cloth holder or plate 140 and presser foot clamp 142 under needles 40, 42. In the discussion of FIGS. 4 and 5, the X direction will be considered to be forward and backward direction that is transverse to the plane that contains twin needles 40, 42; the Y direction is parallel to the axis of upper arm 12; and the Z direction is the vertical direction that is parallel to the reciprocating motion of needles 40, 42.

MECHANISM FOR X-Y-Z MOVEMENT

Movement in the Y direction is achieved by movement of block 146 along slide rods 148, 150 that are supported between spaced mounting brackets 250, 252. Mounting brackets 250, 252 are bolted to the back side of upper arm 12. Suitable linear bearings **148*b*, 150*b* are retained in through-bores in block 146 to provide smooth, low friction, movement of block 146 on slide rods 148, 150. A pair of integral bearing blocks 154, 156 are at opposite lower corners of block 146 and each contains a respective linear bearing 154*b*, 156*b* that extends parallel to the X direction. A second pair of slide rods 158, 160 is received in the linear bearings 154*b*, 156*b* and each has its ends secured in a respective pair of corner posts 159 that are part of a spider member 162 that has a unitary web 164 that extends between the corner posts 159**.

A pair of elongated blocks 168, 170 are integral to spider 162 and extend in the X direction. Blocks 168, 170 are symmetrically positioned on the underside of spider member 162 and each has a respective centrally positioned, vertically oriented, linear bearing therein that is accessible from the bottom side of the block. A second pair of blocks 174, 176 are substantially similar to blocks 168, 170 and extend from the top surface of rectangular platform 178. Blocks 174, 176 are positioned in registration with blocks 168, 170, and each has a post secured at its center that is slidingly received in a respective linear bearing of one of the block 168, 170.

A linear actuator such as air cylinder 182 has its housing secured to the underside of the web portion 164 of spider web 162 and has a central, linearly movable stem 184 that extends downwardly and is secured to the top surface of platform 178. Stem 184 is adapted to reciprocate vertically (Z direction) as the piston of air cylinder 182 is activated up and down in response to programmed command signals that are produced by the control systems. The activation of air cylinder 182 selectively moves platform member 178 up and down.

Two spaced-apart presser foot clamp members 190, 192 are secured to the bottom surface of platform member 178. As illustrated in FIGS. 5 and **5*a*, each presser foot clamp member has a pivot joint 194 adjacent its secured end that permits a limited angular movement of the clamp member. Respective compression springs 196 urge each clamp downwardly and away from platform member 178. The spring biasing of clamp members 190 and 192 permits the cloth holder 140 and presser foot clamp members 190, 192** to readily accommodate different thicknesses of material therebetween. As illustrated in FIG. 5*a*, the clamp members 190, 192 each has one straight edge along its length and an opposite edge that includes a step to a wider base. When the twin needles must be very close together, the clamps 190, 192 are secured to platform 178 with their straight edges adjacent each other so that their apertures 190*a* and 192*a* will be close together. To obtain the maximum spacing between apertures 190*a* and 192*a* to match a wide spacing between needles 40 and 42, the positions of clamp members 190, 192 on platform 178 are reversed so that the straight edges thereon are on the outsides of the clamps. This arrangement move apertures 190*a* and 192*a* farther apart.

The movement of cloth holder 140 in the X and Y directions is by means of respective reversible stepping motors that respond to respective series of stepping pulses produced by the programmed control system. The reversible stepping motors are of the type commonly used for this purpose and are commercially available. As illustrated in FIG. 5, the pair of substantially identical mounting brackets 250, 252 are bolted to the back side of upper arm 12 and support opposite ends of the Y-direction slide bars 148, 150. X-direction stepping motor 256 is mounted on the outside surface of mounting bracket 250 and its rotary shaft 258 extends through an aperture in the bracket. A drive shaft 260 is axially coupled at its left end to motor shaft 258 and is rotatable supported at its right end in support bracket 252.

Figure 5B:
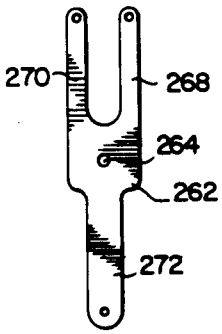
Figure 5A:
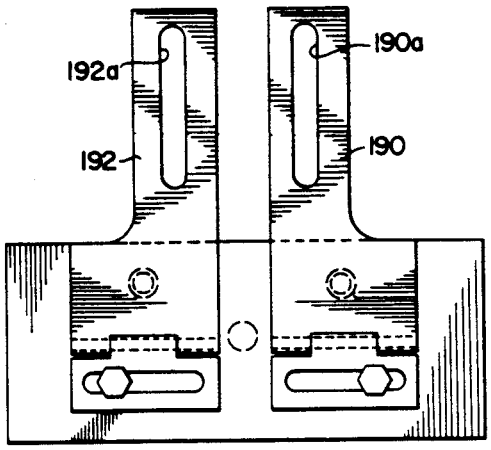

Approximately midway on X drive shaft 260 is secured a thin, flexible, metal drive strap 262 having the shape illustrated in FIG. 5*b*. Drive strap 262 is a known type of drive device that is capable of providing repeatedly accurate translation from rotary to linear motion. Strap 262 is secured at its aperture 264 to drive shaft 260. Double fingers 268 and 270 of the strap are bent counterclockwise around shaft 260 and are secured at their apertures 268*a*, 270*a* to the top of block 266 that is secured to spider 162 of the X-direction slide. The single finger 272 of strap 262 is bent around shaft 260 in the clockwise direction, passes between the two spaced fingers 268, 270, and is secured at its aperture 272*a* to block 266. With this arrangement, rotation of drive shaft 260 in a first direction by motor 256 causes block 266 and X-slide spider 162 to move in a first linear direction, along slide bars 158, 160, and rotation of drive shaft 260 in the opposite direction moves X-direction spider 162 in the opposite linear direction.

As seen in FIG. 5, a slide rod 290 extends between the two corner blocks 159 on X direction spider 162. A linear bearing 266*b* extends through the base of block 266 and permits slide rod 290 to slide through block 266 as spider 162 moves back and forth in the Y direction. It is seen that block 266 should not move in the Y direction because of the coupling of drive strap to drive shaft 260.

Block 266 moves in the X direction by pushing on slide bar 290 on spider 162 and slides in the X direction on a single slide rod 294 that extends between the bottom of slide block 146 and the top of spider 162. Rod 294 is secured to a bracket 296 on the bottom of upper arm 12.

Movement in the-Y-direction of slide block 146 along slide rods 148, 150 is accomplished in substantially the same manner just described. A third mounting bracket 280 is supported between mounting brackets 250, 252 and supports the Y-direction reversible stepping motor 282 thereon. The Y-direction motor shaft is coupled to drive shaft 284 and is rotatably supported at its right by upper arm 12. A second drive strap 286 is secured to Y drive shaft 284 for moving slide 114 in response to commands sent to the Y-direction motor 282 by the programmed control system. Drive strap 286 is identical to strap 262 of FIG. 5*b* and operates in the same manner as described above to provide accurate, programmed movement to Y-slide 146.

LOWER ARM ASSEMBLY

Figure 7:
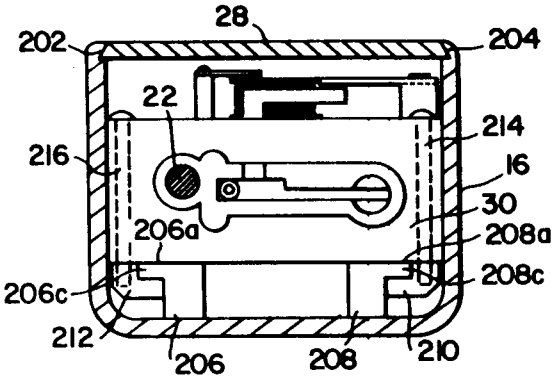

The details of channel shaped lower arm 16 are best seen in FIGS. 6 and 7. Lower arm 16 is made from a short length of channel shaped metal whose top edges are machined to form the dovetail notches 202, 204 which are adapted to slidingly receive therebetween the cover plate 28. A plate is secured to the right end of bottom arm 16 and is provided with suitable means, such as bolts, to rigidly attach arm 16 to a wall of vertical arm 14.

Bottom arm 16 has a pair of parallel slides 206, 208 secured to its inside bottom surface. Slides 206, 208 have top slide surfaces 206*a* and 208*a* and have outwardly extending clamping portions 206*c* and 208*c* at the top ends. Hook blocks 30 and 32 are positioned at their desired locations on top of slides 206 and 208 and are clamped thereto by means of respective clamps 210, 212 that are drawn up tightly against the clamping portions 206*c* and 208*c* of the slides by means of a plurality of elongated bolts 214, 216 that pass vertically through blocks 30 and 32.

Main drive shaft 22 passes through the interior of arm 16 and has a pair of spaced bevel gears 220, thereon that mesh with respective bevel gears 222 in blocks 30 and 32 to rotate the bobbin and loop forming means in the respective blocks. The bevel gears are secured to drive shaft 22 by set screws so that their positions on shaft 22 may be moved when loop blocks 30 and 32 are moved to stitch belt loops of different widths. The blocks are moved to desired positions on slides 206, 208 by loosening clamps 210 and 212, repositioning the blocks and the bevel gears on shaft 22, reengaging the bevel gears, and again tightening clamps 210, 212 against the slides.

Each block 30, 32 includes an air actuated cylinder 230, 232 that operates a respective movable knife blade 234, 236 on the block. Respective air hoses (not illustrated) are coupled to the cylinders to supply the air on command from the programmed control system. With this arrangement there is no requirement for a mechanical connection between the two blocks to actuate the movable blades. The bobbin and hook mechanisms themselves may be of conventional construction and operation.

NEEDLE BAR DRIVE MECHANISM

Figure 8:
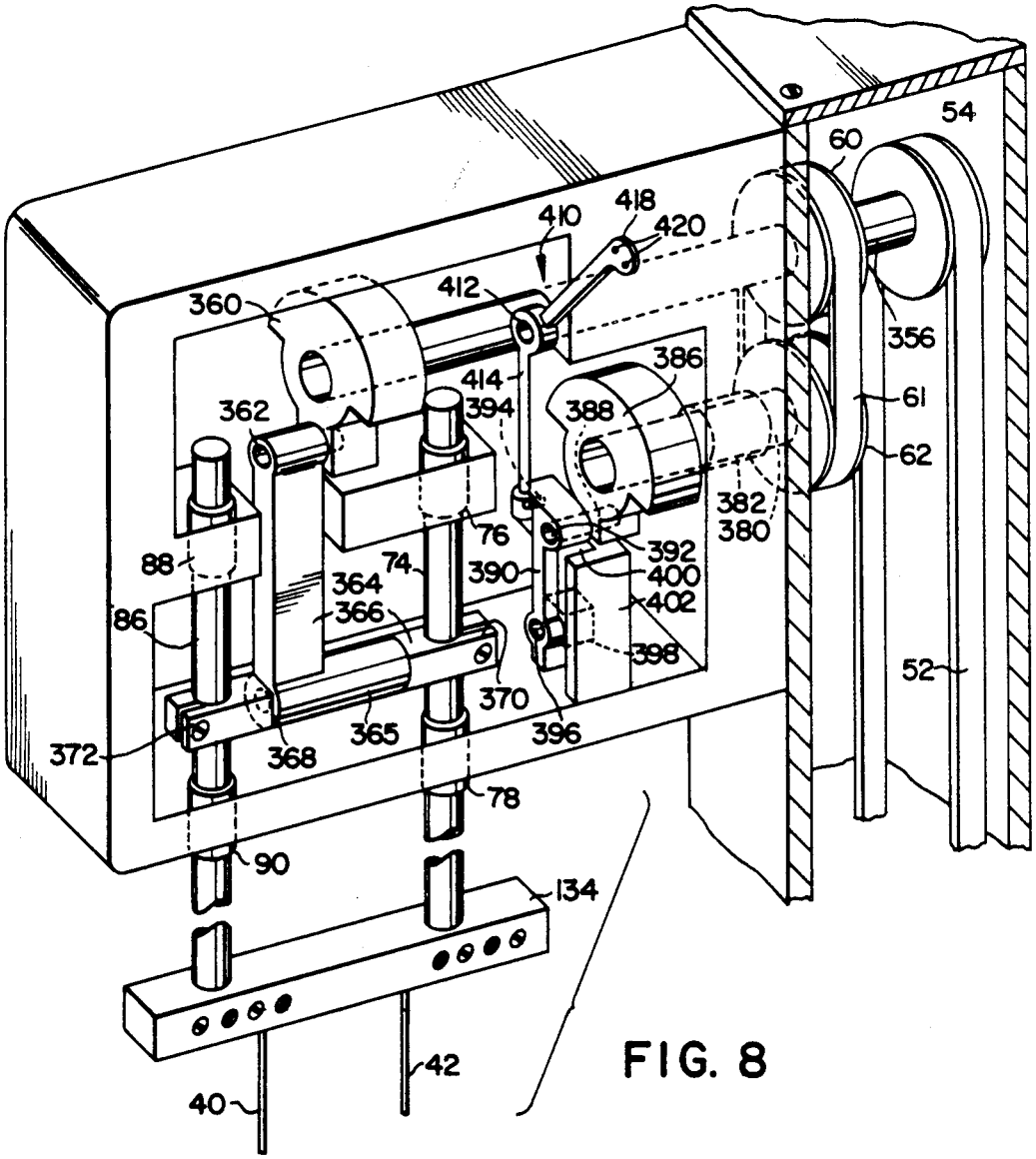
FIG. 8 is another embodiment of apparatus in the upper arm for reciprocating the twin needles.

In the drive means for the twin needle bars 74 and 86 illustrated in FIG. 3, each needle bar is driven by its respective crank wheel and crank arm, thereby requiring rather precise synchronization of those two drive means. FIG. 8 is a simplified illustration of an alternative embodiment of a needle bar drive means in which both needle bars are driven by a single drive means, but the thread puller, or thread take-up lever, is driven by a separate drive mean that is synchronized to the motion of the needle bars. In FIG. 8, the parts that are common to those in FIG. 3 will be designated by the sam numerals.

The means for coupling the needle bar drive mechanism of FIG. 8 to the sewing machine motor is substantially the same as in FIG. 3 and includes belt 52 that rotates pulleys 54 and 60 on upper horizontal rotatable shaft 356. The upper shaft 356 rotates in suitable bearings, as illustrated. A first crank wheel 360 is secured to the left end of upper shaft 356 and rotates therewith. A crank pin 362 is secured eccentrically to the outer face of crank wheel 360 and a crank arm 364 is pivotally connected to crank pin 362. The bottom of crank arm 364 a horizontal arm 365 whose two ends 366 and 368 are bored out and provided with suitable bushings to pivotally receive cylindrical studs on the respective clamp members 370 and 372. The two clamp members are secured to the respective needle bars 74 and 86 which reciprocate up and down in their respective pairs of bushings 76, 78 and 88, 90.

The rotary motion of shaft 356 is coupled by belt 61 and pulley wheel 62 to the second horizontal shaft 380 which is rotatably supported in bushing 382. A second crank wheel 386 is secured to the left end of shaft 380 and has an eccentric pivot pin 388 secured in its outer face. A take-up link 390 has a bushing 392 in its top head that is pivotally connected to pin 388 in crank wheel 386. The bottom end of take-up link 390 terminates in a bushing 396 that pivotally receives a key block 398 that is slidingly received in keyway 400. The keyway is machined into a block 402 that is attached to the interior of the upper arm.

The thread take-up lever 410 is pivotally supported at pivot joint 412 to the body of the sewing machine upper arm. The lever arm 414 of take-up lever 410 is pivotally joined to the head of take-up link 390 by a pivot joint 394. Upper arm 418 of thread take-up lever 410 has two thread receiving apertures 420 through which the two strands of thread pass on their way to needles 40, 42.

In the operation of the apparatus illustrated in FIG. 8, the rotation of drive pulley 54 causes upper shaft 356 and crank wheel 360 to rotate in like manner. The rotation of eccentric pin 362 on crank wheel 360 causes crank arm 364 to rise and fall as the wheel rotates. Because bottom arm 365 of crank arm 364 is pivotally clamped to the two needle bars 74, 86, the needle bars reciprocate up and down in their respective bushings. Therefore, needle clamp 134 and needles 40, 42 reciprocate up and down with the rotation of drive pulley 54. It is seen that the two needle bars are spaced symmetrically on needle clamp 134 and therefore prevent the clamp from tilting and the needles from sewing erratic patterns or missing the looped threads in the bottom arm of the machine. Once the clamps 370, 372 are properly adjusted and secured to the needle bars, no further adjustment or synchronization between the needle bars is required.

The rotation of bottom horizontal shaft 380 by means of pulley wheel 60, belt 61 and pulley wheel 62 rotates crank wheel 386 in the same direction as crank wheel 360. Rotating eccentric pin 388 causes the take-up link to rise and fall. Because key block 398 slides up and down in keyway 400, there is only vertical motion at the bottom of take-up link 390. The connection at pivot joint 394 of the lower arm 414 of take-up lever 410 to the head of take-up link 390 causes the upper arm 418 of the lever to rock up and down about its pivot 412 as crank wheel 386 rotates. Adjustment of the timing between the thread take-up lever 410 and the motion of needles 40, 42 may be made by changing the position of pulley wheel 62 relative to pulley 60 within belt 62.

From the above discussion it is evident that the construction of the sewing machine has been simplified and its size made smaller by attaching the X-Y-Z motion apparatus on the upper arm and attaching the cloth holder and clamp to that mechanism. The quality of stitching performed by the machine is improved by providing double needle bar drives for the needle clamp, thereby providing more rigidity and stability to the single needle clamp.

In its broader aspects, this invention is not limited to the specific embodiment illustrated and described. Various changes and modifications may be made without departing from the inventive principles herein disclosed.

I claim:

1. A sewing machine comprising the combination of an elongated, horizontally disposed needle clamp, a top horizontal arm containing drive means for reciprocating with a vertical motion said elongated, horizontally disposed needle clamp, first and second rigid needle bars extending downwardly from said top arm and spaced apart in a direction of elongation of said needle clamp, said needle bars being associated with said drive means and for reciprocation in unison by said drive means, said spaced needle bars being secured to said needle clamp at symmetrically spaced positions thereon to provide rigid, balanced support for said needle clamp, and means for securing a pair of needles to said needle clamp, a bottom horizontal arm positioned substantially parallel to said top arm and containing thread looping means for cooperating with thread carried by the needles in said needle clamp to form stitches in a workpiece, and a vertical arm extending between ends of said top arm and bottom arm and maintaining them in fixed relationship with each other, a cloth holder for holding the workpiece to be stitched, support means attached to said top arm for supporting said cloth holder in a position below said needle bars so that the needles pass through the workpiece on the cloth holder when the needle bars are vertically reciprocated, first means attached to said support means for moving said cloth holder in a first horizontal direction relative to said reciprocating needles, second means attached to said support means for moving said cloth holder in a second horizontal direction that is transverse to said first horizontal direction, and extendable clamping means supported from said horizontal arm and movable with said cloth holder for clamping the work piece onto said cloth holder when in an extended position.

2. The sewing machine claimed in claim 1 wherein said clamping means includes a clamp member having means for moving solely vertically relative to said holder,

3. The sewing machine claimed in claim 2 wherein said cloth clamping means is supported on the second one of said means for moving said cloth holder in said second horizontal direction.

* * * * *